United States Patent [19]

Bontempo

[11] Patent Number: 4,957,319

[45] Date of Patent: Sep. 18, 1990

[54] GOLF BALL RETRIEVER

[76] Inventor: Angelo Bontempo, 19426 Riverview Ave., Rocky River, Ohio 44116

[21] Appl. No.: 366,643

[22] Filed: Jun. 15, 1989

[51] Int. Cl.[5] ..... A63B 47/02

[52] U.S. Cl. ..... 294/19.2; 294/66.1

[58] Field of Search ..... 294/19.2, 49, 51, 52, 294/53.5, 55, 59, 66.1; 56/328.1, 400.01, 400.04–400.07, 400.11–400.13, 400.21; 209/417–419; 273/32 D, 32 F, 162 R, 162 B, 162 E, 162 F

[56] References Cited

U.S. PATENT DOCUMENTS

| | | | |
|---|---|---|---|
| 929,479 | 7/1909 | Parker | 294/55 X |
| 1,431,968 | 10/1922 | McDermott | 294/19.2 |
| 2,270,632 | 1/1942 | Hasty | 294/19.2 |
| 2,738,214 | 3/1956 | Zimmers | 294/19.2 |
| 2,864,228 | 12/1958 | Griffith | 294/19.2 X |
| 3,276,807 | 10/1966 | Ward | 294/19.2 X |
| 3,442,544 | 5/1969 | Faber | 294/19.2 |
| 3,614,149 | 10/1971 | Clark | 294/51 X |
| 4,635,987 | 1/1987 | Hurtgam | 56/400.11 X |
| 4,730,859 | 3/1988 | Gabinet | 294/19.2 |
| 4,799,725 | 1/1989 | Anderson | 294/55 X |

FOREIGN PATENT DOCUMENTS

| | | | |
|---|---|---|---|
| 549203 | 11/1957 | Canada | 56/400.12 |
| 469482 | 7/1937 | United Kingdom | 294/19.2 |

*Primary Examiner*—Johnny D. Cherry

[57] ABSTRACT

A golf ball retriever for retrieving golf balls from water and other inaccessible places. The retriever consists essentially in a receptacle for a golf ball or balls and consists of a plurality of elongated rods disposed in spaced generally parallel relation to each other and which are mounted at their opposite ends to a pair of end plates. A golf shaft, pole, or the like is secured to the receptacle to provide a handle therefor. A stabilizing fin may be secured to the receptacle.

3 Claims, 2 Drawing Sheets

GOLF BALL RETRIEVER

FIELD OF THE INVENTION

This invention relates to a rake device for use in retrieving golf balls from water hazards and other highly inaccessible areas or the like and relates more particularly to a rake device which may be attached to any retriever, golf club, rod or the like.

DESCRIPTION OF THE PRIOR ART

Various devices for scooping or raking a golf ball from a water hazard or other inaccessible areas have been known. U.S. Pat. No. 4,254,981 issued Mar. 10, 1981 to Wilson discloses a rake with a plurality of retrieving fingers and although the Wilson device purports to be an improvement over the U.S. Pat. No. 2,738,214 issued Mar. 13, 1956 to Zimmers, which often drops the golf ball when lifted from the hazard, the Wilson device will also occasionally drop the golf ball. Other devices with fingers to grasp a ball, such as U.S. Pat. No. 3,306,650 issued Feb. 28, 1967 to Zagwun and U.S. Pat. No. 4,046,413 issued Sept. 6, 1977 to Jeniga, present the same problem.

SUMMARY OF THE INVENTION

The rake attachment of the present invention allows a golf ball to be held in place without falling out of the attachment before the golfer removes it. Most golfers carry a golf ball retriever and the rake attachment of this invention enables the use of both an existing golf ball retriever and this attachment. It is proposed that if the rake attachment of the present invention is attached to and placed facing in the opposite direction of the conventional single golf ball retriever, it will not hinder the use of the said single golf ball retriever when it is needed. For instance, when a golf ball is among rocks, the single golf ball retriever may be easily used.

The rake attachment of this invention is provided with means for seating and retaining a golf ball.

The invention further has the capability of retrieving more than one golf ball at a time, and is adapted to be attached to a retriever carried in the golf bag along with the clubs and easily removed and stored in the golf bag. The golf ball retriever rake attachment of the present invention is further adapted to be attached to any existing retriever or club shaft or rod of various types.

In the past, when a golfer attempts to retrieve a golf ball from a water hazard, the golfer usually cannot see the golf ball because of suspended soil and other materials in the water and/ or refraction of rays passing through the air-water interface.

The attachment device of this invention enables a golfer to retrieve the golf ball in hazards with visual hinderances with greater ease than with prior devices. When the present attachment is pulled through the water in the general area of the golf ball, the golfer can actually feel the golf ball drop into the attachment as a result of tactile cues which vibrate through the shaft to which it is attached. Additionally, the device is more likely to trap the lost golf ball, as well as any surrounding stray golf balls, than devices of other dimensions and/or more restrictive openings is in U.S. Pat. No. 3,717,371 issued Feb. 20, 1973 to Halone.

The above and other objects and advantages of the present invention will become more apparent from the following detailed description appended hereto in which reference is made to the accompanying drawings.

IN THE DRAWINGS

Figure 1:
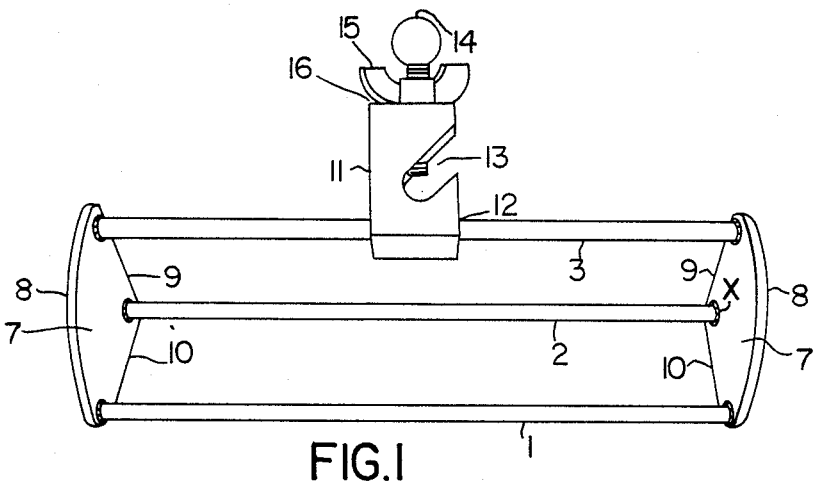
FIG. 1 is a top plan view of the golf ball retriever of this invention.

Referring now more specifically to the drawings in all of which like parts are designated by like reference characters and more particularly to FIG. 1, the rake attachment of this invention comprises elongated spaced parallel horizontal rods 1, 2 and 3 secured preferably at their outer opposite ends to end plates 7 preferably by projecting the ends of the rods 1, 2, and 3 through spaced openings 4, 5 and 6 in pairs of the oppositely disposed end plates 7 and the rods are secured as shown at "x" by reaming the ends of the rods over surfaces of the plate surrounding the openings or by riveting the same thereto or by other fastening means. The end plates are preferably, as shown, flat rectangular plates, each having a pair of adjoining angular sides 9 and 10 and a curved side 8.

Figure 2:
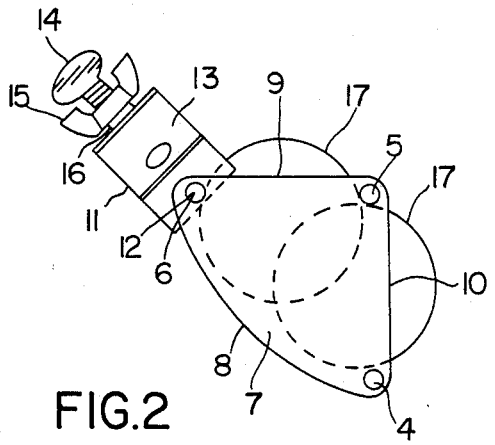
FIG. 2 is an end view of the rake attachment of FIG. 1 disclosing in dotted lines golf balls trapped between a pair of rods of the rake attachment.
Figure 3:
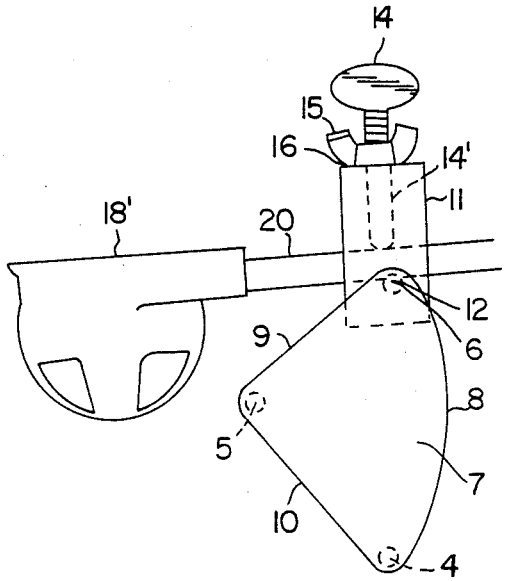
FIG. 3 is a side view of the rake attachment of FIG. 2 secured to a conventional golf ball retriever.
Figure 4:
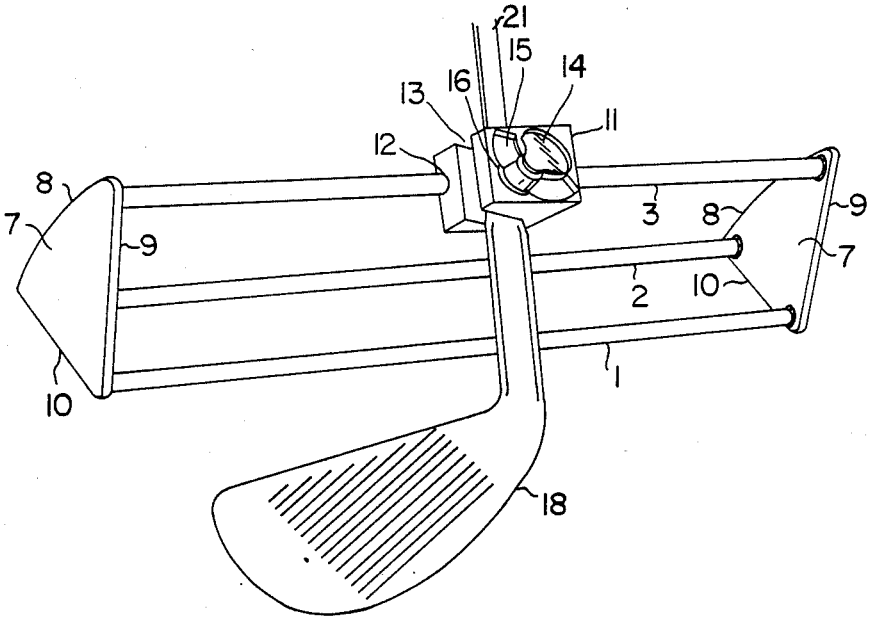
FIG. 4 is a top plan view of the rake attachment showing the same secured to a golf club.

The space provided between the rods 1 and 2 and the space between rods 2 and 3 is selectively less than the diameter of a golf ball and the space between rods 1 and 3 substantially larger than the diameter of a golf ball wherefor when the rake, is clamped to handle means such as a shaft of a conventional ball retriever 18', as shown in FIG. 3, or to the shaft of a golf club 18, as shown in FIG. 4, or to a pole or the like, by adjustable clamping means 11, a ball or balls 17 will be received and retained within the pocket therefor provided by the space between the rods 1, 2 and 3, and the golf ball or balls 17 easily moved over the leading rod 1 and into the pocket or within a cup-like receptacle 18' carried at the forward end of the rake on the handle means. The top rod 3 prevents, as shown in FIG. 2, the ball or balls 17 from egress through the space between rods 2 and 3 after recovery from the water, tall grass, or other inaccessible areas where the same was located and into which area the rake was inserted and the back rod 2 prevents a golf ball captured by the rake from egress through space between rod 1 and rod 2. Each of the opposite end plates 7, as stated herein before, are provided with curved leading surfaces 8 which enable the rake to slide easily over any projecting ledge or obstruction under the water and prevent the same from being "snagged" on any obstruction under water.

Figure 5:
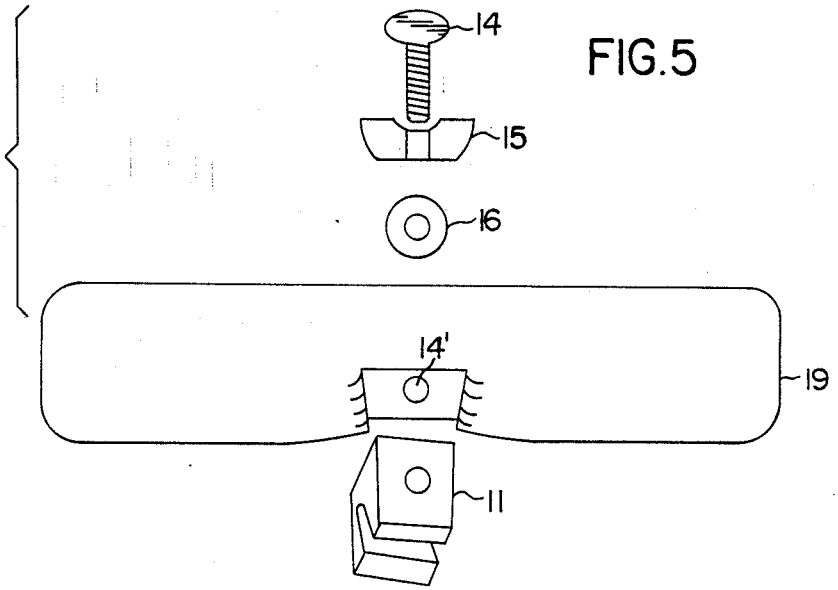
FIG. 5 is an exploded view of a stabilizer to be secured to the rake attachment.

As shown in FIG. 5, an elongated stabilizer fin 19 may be attached by the clamping means 11 to the rake or detached therefrom when not clamped as in the case of the shaft of a retriever or golf club shaft or pole. As shown in the Figures, the clamping means 11 are generally U-shaped with an elongated opening 13 in mid-section thereof, as shown in FIGS. 1, 2, 3 and 4 adapted for placement therein of a retriever shaft, a shaft 21 of a golf club 18 as shown in FIG. 4 or a handle 20 of a cup-like receptacle 18' as shown in FIG. 3. An opening 14' is disposed in the clamping means 11 vertically therethrough. As shown in FIG. 3, a screw-threaded bolt 14 is adapted to be disposed in the opening 14' to secure handle means thereto in fixed position. A wing nut 15 is adapted to be rotated with respect to the threads on the bolt 14 to securely maintain the shaft on the clamping means 11. A washer 16 may be employed therewith as shown in FIG. 5 when attaching the stabilizer fin 19 to the rake attachment. It is to be noted that the clamping means 11 is also provided with an opening 12 in the lowermost end thereof to seat the clamping means adjustably on the rod 3 as shown.

WHAT I CLAIM IS:

1. A rake-like retriever for a golf ball or balls comprising: a receptacle therefore comprising a plurality of elongated parallel rods, a pair of oppositely disposed end plates, securing means for securing each of said rods at its opposite ends to said pair of oppositely disposed end plates, the said plates having leading edges, at least two of said rods secured to said plates being spaced a distance less than the diameter of a golf ball and at least one of said rods having a leading edge disposed in spaced relation to another of said rods a distance greater than the diameter of a golf ball, an elongated handle, means for securing the said handle to one of said rods.

2. A retriever for a golf ball or balls as claimed in claim 1 having an elongated stabilizer fin secured thereto.

3. A retriever for a golf ball or balls as claimed in claim 1 wherein the handle contains a cup-like receptacle for a single ball and said single ball receptacle is mounted on the rake-like retriever and extending forwardly thereof.

* * * * *